US005291728A

United States Patent [19]

Stahlecker et al.

[11] Patent Number: 5,291,728

[45] Date of Patent: Mar. 8, 1994

[54] SPINING MACHINE HAVING SLIVER TRANSPORT BELTS AND LATERAL GUIDING ELEMENTS FOR THE TRANSPORTS BELTS

[75] Inventors: Fritz Stahlecker, Josef-Neidhart-Strasse 18, 7347 Bad Überkingen; Werner Zott, Donzdorf, both of Fed. Rep. of Germany

[73] Assignees: Fritz Stahlecker; Hans Stahlecker, both of Fed. Rep. of Germany

[21] Appl. No.: 871,098

[22] Filed: Apr. 20, 1993

[30] Foreign Application Priority Data

Jul. 23, 1991 [DE] Fed. Rep. of Germany ..... 4124313

[51] Int. Cl.[5] ..... D01H 13/04

[52] U.S. Cl. ..... 57/90; 198/806

[58] Field of Search ..... 57/90, 315; 198/836.1, 198/840, 806, 839

[56] References Cited

U.S. PATENT DOCUMENTS 928,365 7/1909 Cowley ..... 198/836.1
1,821,664 9/1931 Peiler ..... 198/840
2,251,879 8/1941 Akaboshi ..... 57/90 X

FOREIGN PATENT DOCUMENTS 512827 5/1955 Canada ..... 198/840
2439507 2/1976 Fed. Rep. of Germany ... 198/836.1
2-21423 9/1990 Japan ..... 57/315
1015780 1/1966 United Kingdom .

*Primary Examiner*—Joseph J. Hail, III
*Attorney, Agent, or Firm*—Evenson, McKeown, Edwards & Lenahan

[57] ABSTRACT

In the case of a spinning machine for the spinning of slivers fed in cans into yarns, drivable transport belts are provided which transport the slivers between the cans and the spinning stations. Stationary lateral guides are assigned to the transport belts immediately before they run onto deflecting rollers, the distance between these stationary lateral guides being maximally as large as the width of the deflecting rollers. At the point of the lateral guides, a rear support is provided which is in a slight contact with the transport belt.

4 Claims, 4 Drawing Sheets

SPINING MACHINE HAVING SLIVER TRANSPORT BELTS AND LATERAL GUIDING ELEMENTS FOR THE TRANSPORTS BELTS

BACKGROUND AND SUMMARY OF THE INVENTION

This invention relates to a spinning machine comprising several spinning stations, with depositing sites for cans containing sliver and with transport devices comprising transport belts for the conveying of the slivers from the cans to the spinning stations, stationary lateral guides being assigned to the transport belts immediately before they run onto deflecting rollers.

In the case of a spinning machine of this type (British Patent Document GB-PS 10 15 780), which is constructed as a ring spinning machine, a second transport belt is assigned to each transport belt. As a result, transport belt pairs are created which each receive a sliver between one another and transport it. A plurality of deflecting rollers is provided which disclose no lateral guide for the transport belts. Stationary lateral guides are provided only for the deflecting rollers which are connected directly in front 20 of the spinning stations and which are drivable. These stationary lateral guides are created by the fact that the deflecting rollers are disposed laterally in fork-type supports by means of journals. This type of a lateral guiding of transport belts is useful only when the transport belts are stretched very tightly. However, high tension forces present problems in cases where at the same time large driving forces must be applied to the transport belts. The reason is that ring spinning machines may easily have a thousand spindles, and as a result, driving rollers, on the whole, must transmit a considerable circumferential force, whereby they are twisted unacceptably. However, side rims on deflecting rollers cannot be used for lightly tensioned transport belts because in this case the transport belts tend to climb up the side rims.

It is an object of the invention to provide lateral guides for the deflecting rollers in the case of a spinning machine of the initially mentioned type which are suitable particularly also for less tensioned and very thin transport belts.

This object is achieved according to preferred embodiments of the invention in that the distance of the lateral guides from one another is maximally as large as the width of the deflecting rollers and that at the point of the lateral guides a rear support is provided which is in a slight contact with the transport belt.

In this case, the invention is based on the recognition that lightly tensioned transport belts must be guided by means of stationary lateral guides and that each transport belt, shortly before running onto the deflecting roller, must be supported at this point in the rear with a slight contact so that the transport belt is not tilted or twisted. Such lateral guides may be used for drivable deflecting rollers as well as for deflecting rollers that are not drivable.

Advantageously, the rear support is designed as a sliding surface. As a result, the expenditures with respect to the bearing may be reduced. Such a sliding surface may, for example, be arranged on a support extending in the longitudinal direction of the machine which at the same time also carries the lateral guides. As an alternative, such a sliding surface may be a pin which is assigned to an individual transport belt and, in turn, carries the lateral guides.

Other objects, advantages and novel features of the present invention will become apparent from the following detailed description of the invention when considered in conjunction with the accompanying drawings.

DETAILED DESCRIPTION OF THE DRAWINGS

Figure 1:
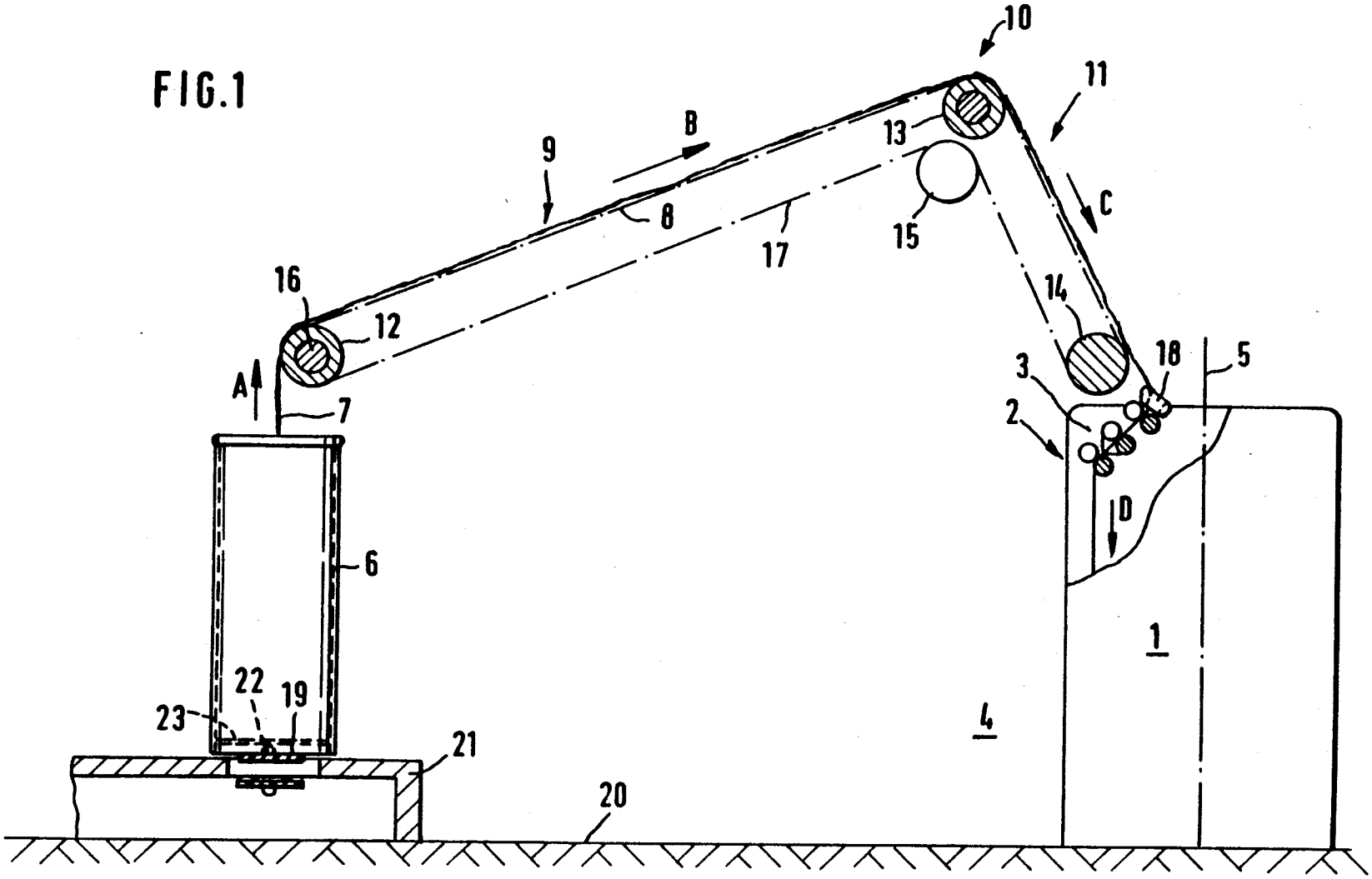
FIG. 1 is a partial cross-sectional view of a machine system comprising a spinning machine, to the spinning stations of which one sliver respectively is fed by means of a can; the slivers being conveyed by means of transport belts from the cans to the spinning stations, constructed according to a preferred embodiment of the invention.

The spinning machine 1 illustrated in FIG. 1, which may, for example, be a ring spinning machine, is shown only schematically. On each side of the machine, it has a plurality of spinning stations 2 arranged next to one another. Only one drafting unit 3 is shown of each spinning station 2 which is constructed as a three-cylinder drafting unit. An operating aisle 4 for operating personnel is situated in front of the spinning stations 2.

On the other side of the longitudinal center plane 5, the spinning machine 1 is equipped in the same manner with spinning stations which are not shown.

On the side of the operating aisle 4 which is opposite the spinning stations 2, cans 6 are deposited which contain the fiber material which is spun in the spinning stations 2. Since the diameter of the cans 6 is larger than the spacing of two adjacent spinning stations 2, the cans 6 are arranged next to one another in several rows in a manner that is not shown.

The fiber material is fed to the spinning stations 2 as a sliver 7 produced on a drafting frame. The slivers 7 have a size of approximately Nm 0.3 to 0.8 so that they can be drafted to the desired fine size by the drafting units 3 constructed as three-cylinder drafting units without any interference with the concentricity of the feeding roller pair of the drafting units 3 by excessively slow rotation.

The relatively fine slivers 7 are transported from the cans 6 to the spinning stations 2 by means of transport belts 8, shown dash-dotted, in such a manner that an unacceptable drafting during the transport is prevented. The individual measures for this purpose are shown in detail in the following figures.

The transport belts 8 extend from an area above the cans 6 in a first run 9 first diagonally upward over the operating aisle 4 to a deflecting guide 10 forming the highest point and from there in a second run 11 also in a sloped manner downward to the spinning stations 2. The transport belts 8, which can accommodate several slivers 7 disposed next to one another, each run over four deflecting rollers 12, 13, 14, and 15. The lateral guides of the deflecting rollers 12 to 15 are not shown in FIG. 1 but will be described by means of the following figures.

The deflecting rollers 12 arranged directly above the cans 6 are rotatably arranged on shafts 16 extending in the longitudinal direction of the machine and are fixed in the axial direction in a manner which is not shown. The same applies to the deflecting roller 13 forming the highest point of the deflecting guide 10. The deflecting roller 14 is a component of a shaft extending through in the longitudinal direction of the machine which is driven from a driving head of the spinning machine 1. In order to avoid twisting, it may be provided in this case that the continuous shaft is divided in the machine center and is in each case driven from the machine end.

The deflecting roller 15, which is adjacent to deflecting roller 13 and guides the returning run 17 of the transport belt 8, is constructed as an individual tension roller, the arrangement of which will be described later.

The slivers 7 are taken out of the cans 6 in the direction of the arrow A, are fed by the transport belt 8 in the direction of the arrow B to the deflecting guide 10, and from there are fed in the direction of the arrow C to a feeding hopper 18 of the pertaining drafting unit 3, and after their drafting are guided in the direction of the arrow D to a twist providing element, such as a ring spindle, which is not shown.

The cans 6 are deposited on conveyer belts 19 extending in the longitudinal direction of the machine which are laid in a platform 21 arranged slightly above the floor 20. The conveyer belts 19 are provided with button-type take-along devices 22 which grip behind the inner lower edge of the normally slightly elevated bottoms 23 of the cans 6, and as a result take along the cans 6 with a certain form closure, transport them and hold them in the desired position. When the conveyer belts 19 are stopped, the cans 6 will therefore be in the correct position in which they remain during the spinning operation.

Figure 2:
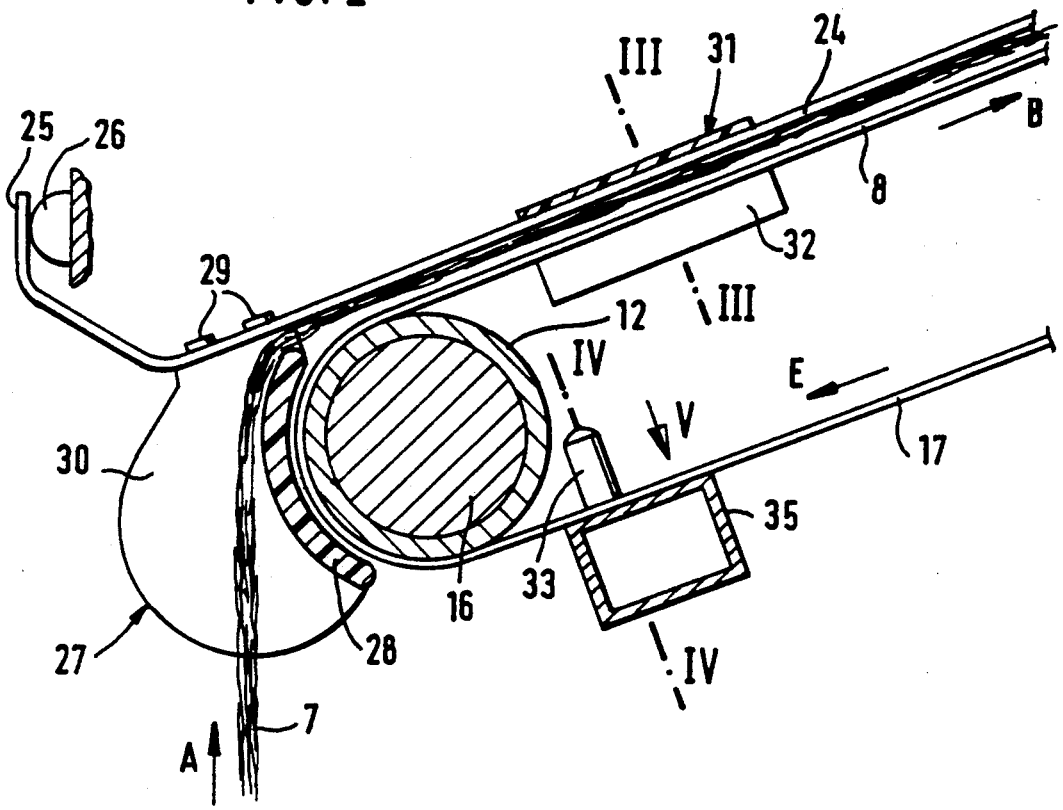
FIG. 2 is a very enlarged detail of FIG. 1 in the area of a deflecting roller arranged above a can.

A skid 24 is assigned to each transport belt 8 and rests preferably with its own weight on the slivers 7 and thus presses the slivers 7 with a slight contact pressure against the transport belts 8 (FIG. 2). The skid 24 is preferably made of sheet metal and has a smooth underside which, with respect to the slivers 7, has a coefficient of sliding friction which is clearly lower than the coefficient of sliding friction of the transport belts 8.

By means of a lengthening 25, the skids 24 are supported in the area of the deflecting roller 12 in the transport direction B against a stop 26. Thus, the skid 24 is positioned in its longitudinal direction.

A rake-type feeding device 27 for the sliver 7 travelling onto the transport belt 8 is assigned to the deflecting roller 12. A wall 28 of the feeding device 27 partially surrounds the deflecting roller 12. The feeding device 27 is riveted to the skid 24 by means of rivets 29. By means of the feeding device 27, the skid 24 is loaded slightly more in the feeding area, whereby the feeding of the sliver 7 is facilitated when it is for the first time placed on the pertaining transport belt 8. Side walls 30 of the feeding device 27 are used for the lateral guiding of the pertaining sliver 7 between the can 6 and the deflecting roller 12.

Figure 3:
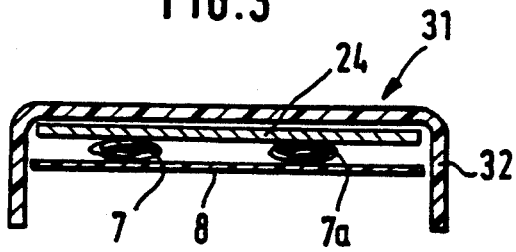
FIG. 3 is a sectional view along the plane of section III—III of FIG. 2.

Above the deflecting roller 12 and directly behind it, the skid 24 carries a rider 31 which reaches around the transport belt 8 by means of lateral walls 32 (see also FIG. 3). FIG. 3 also shows two slivers 7 and **7*a* arranged side-by-side which belong to adjacent cans 6. By means of the rider 31, the skid 24 is guided in the lateral direction, specifically directly above the transport belt 8** which, in turn, is laterally guided in a manner that will be described below.

For the lateral guiding of the respective transport belt 8, two pins 33 and 34 are used (see, in addition to FIG. 2, also FIGS. 4 and 5) which are arranged on the left and on the right of the run 17 of the transport belt 20 8 travelling in the direction of the arrow E. These pins 33 and 34 are connected with a longitudinal rail 35 which extends in the longitudinal direction of the spinning machine 1. At the location where the returning run 17 of the transport belt 8 is guided laterally by the stationary pins 33 and 34, it is also supported from the rear by the longitudinal rail 35. In this case, the run 17 is in a slight contact with the longitudinal rail 35. As a result, a tilting or a twisting of the transport belt 8 is avoided in the area of the stationary pins 33 and 34 serving as the lateral guide so that very thin and very lightly tensioned transport belts 8 may also be used which have a slight lateral stiffness.

The pins 33 and 34, which act as a belt fork, function only when the transport belt 8 is supported in the rear in locations where it is laterally guided. In the area of the deflecting roll 12, the rear support is formed by the longitudinal rail 35 onto which the pins 33 and 34 are welded. A comparable lateral guide and rear support for the transport belt 8 may also be provided in a manner that is not shown for the drivable deflecting roller 14 (see FIG. 1).

The principle is therefore to support the respective transport belt 9 immediately before running onto the a deflecting roller 12, 13, 14 or 15 with a slight contact in the rear and to carry out the lateral guiding at this point. It is important to move the rear support as well as the lateral guide close to the respective deflection roller 12 to 15.

The distance x between the pins 33 and 34 serving as the lateral guide for the transport belt 8 or for its returning run 17 is maximally as large as the width y of the deflecting roller 12 , preferably a little smaller. Such a distance x would not be possible if the stationary lateral guide known on the basis of the British Patent Document GB-PS 10 15 780 were used.

Figure 4:
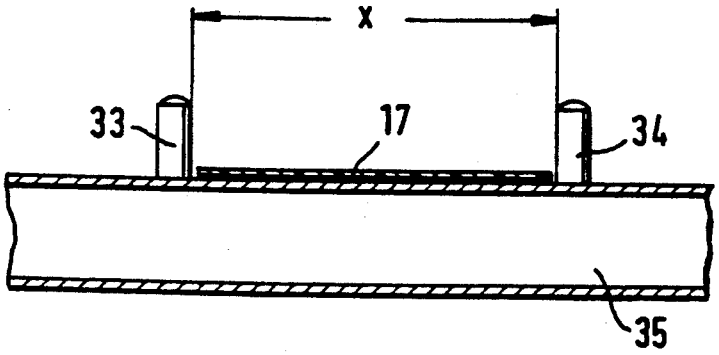
FIG. 4 is a sectional view along the plane of section IV—IV of FIG. 2.
Figure 5:
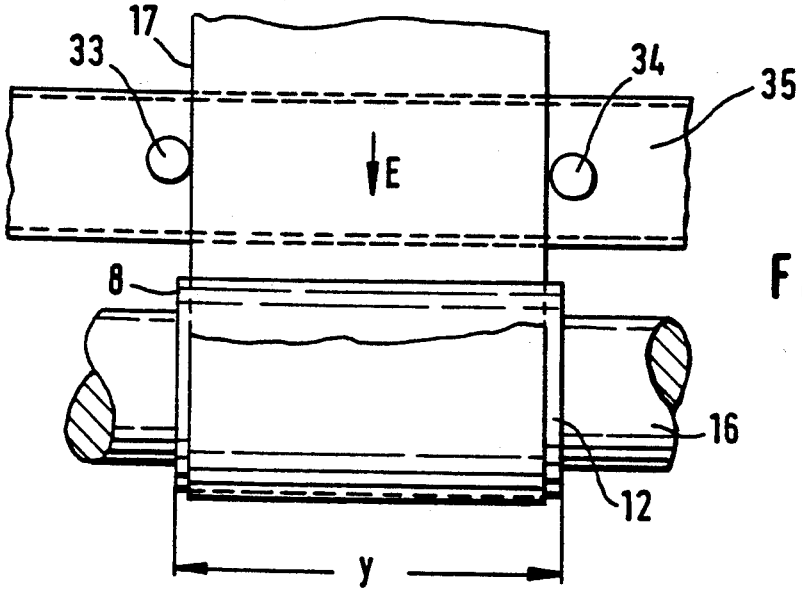
FIG. 5 is a view in the direction of the arrow V of FIG. 2.
Figure 6:
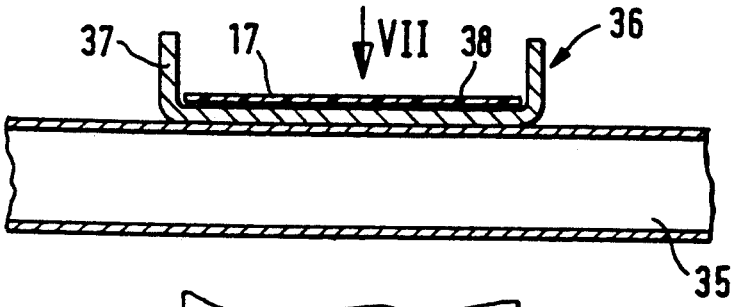
FIG. 6 is a sectional view similar to FIG. 4 showing a modified embodiment.
Figure 7:
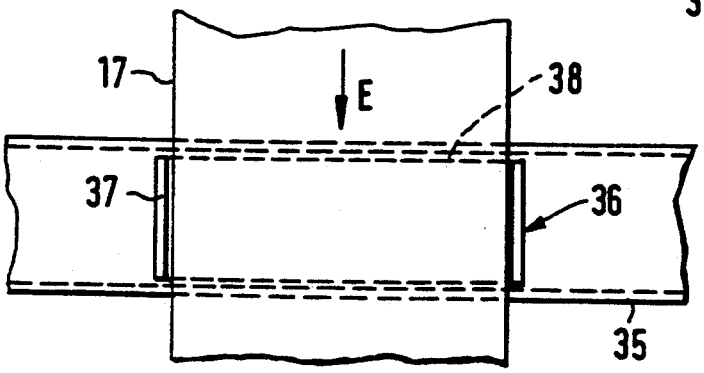
FIG. 7 is a view in the direction of arrow VII of FIG. 6.

An alternative to the construction according to FIGS. 4 and 5 is illustrated in FIGS. 6 and 7. Here, a guiding bow 36 is spot-welded onto the longitudinal rail 35, the flanges 37 of this guide bow 36 serving for the lateral guiding of the returning run 17 of the transport belt 8. The web 38 of the guide bow 36 forms the above-described rear support. Thus the transport belt 8 is protected from crossing in the area of the lateral guides 37, on the one hand, by the cylindrical surface of the deflecting roller 12 and, on the other hand, by the guide bow 36.

Figure 8:
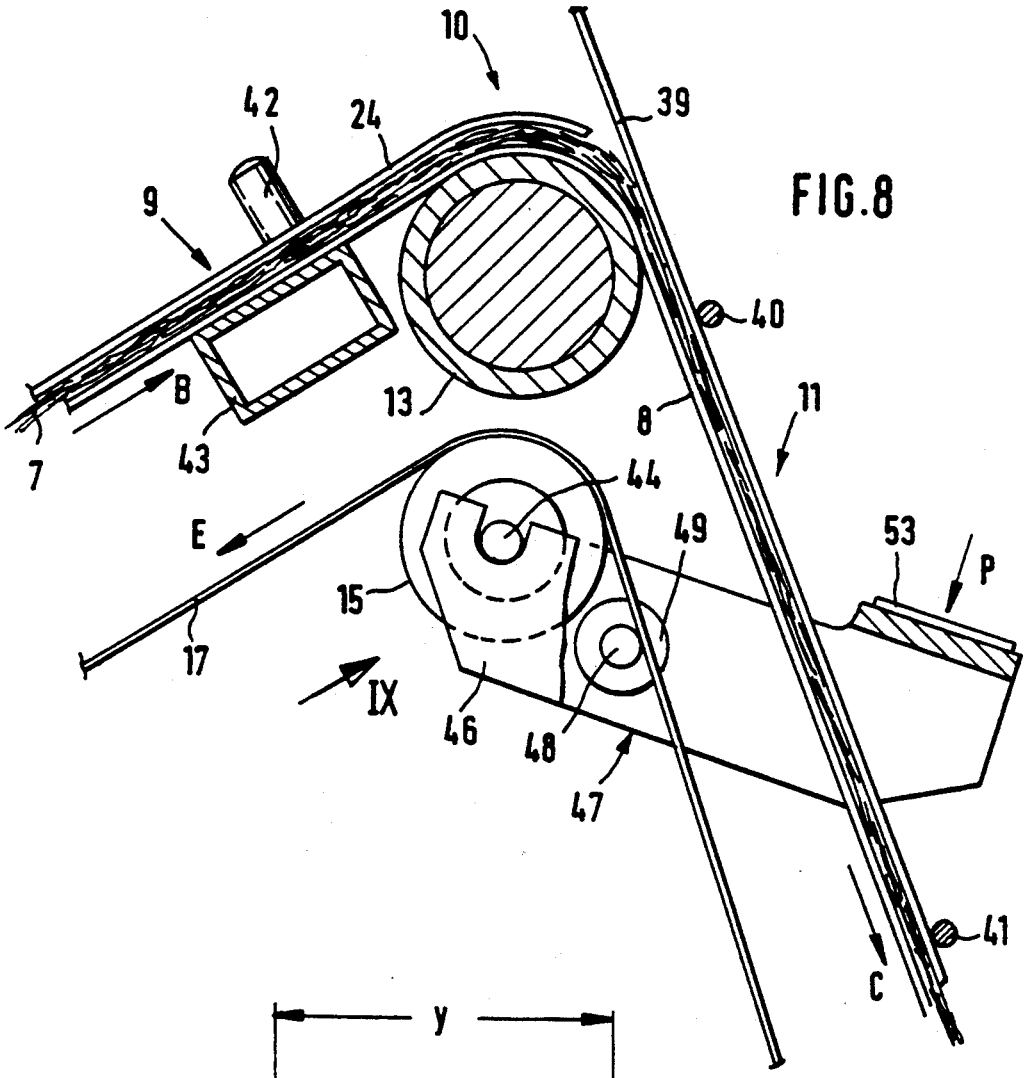
FIG. 8 is a very enlarged detail from FIG. 1 in the area of two deflecting rollers defining the highest point of the transport belts.
Figure 9:
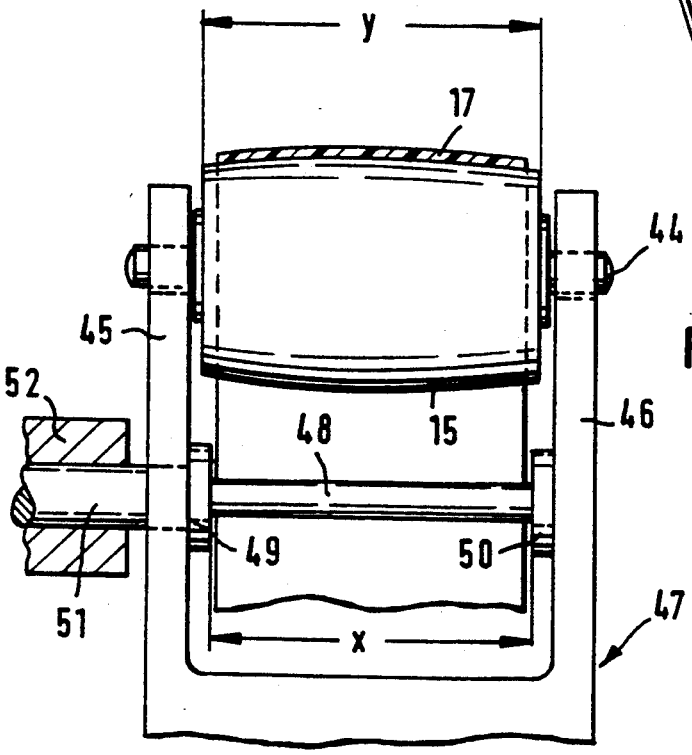
FIG. 9 is a view of FIG. 8 in the direction of the arrow IX.

FIGS. 8 and 9 show the lateral guide of the transport belt 8 or of its returning run 17 in the area of the deflecting roller 13 forming the upper deflecting guide 10 and in the area of the deflecting roller 15 serving as the tension roller.

The front area of the skid 24 is recognized which still rests on the sliver 7 also at the deflecting roller 13 and with its end slightly follows the contour of the deflecting roller 13. Similarly to how the skid 24 is assigned to the run 9 of the transport belt 8, a skid 39, which in a manner which is not shown is suspended above the deflecting roller 13, is assigned to the run 11 of the transport belt 8 which extends diagonally downward. The skid 39 is pressed by means of adjustable rods 40 and 41 with a slight pressure against the sliver 7 and thus against the transport belt 8.

In the transport direction B directly in front of the deflecting roller 13, lateral pins 42 are again provided which are mounted on a longitudinal rail 43 extending in the longitudinal direction of the machine. As already described in connection with the deflecting roller 12, the pins 42 form a lateral guide for the transport belt 8, whereas the longitudinal rail 43 supports the transport belt 8 in the rear in the area of the lateral guide. The distance between the two pins 42, which is not visible, again is maximally as large as the width of the deflecting roller 13, but in any case is as wide as the width of the transport belt 8 plus a small safety distance.

As mentioned above, the deflecting roller 15 guiding the returning run 17 of the transport belt 8 is constructed as an individual roller and is designed as a tension roller. As shown in FIG. 9, it is designed to be slightly crowned.

By means of lateral pins 44, the deflecting roller 15 is received in two arms 45 and 46 of a swivelling bow 47. Between the arms 45 and 46, a transverse pin 48 is mounted which preferably is non-rotatable. It has side rims 49 and 50, the spacing x of which is smaller than the width y of the deflecting roller 15 and which laterally guide the returning run 17 of the transport belt 8. If the side rims 49 and 50 did not exist, no perfect lateral guiding for the transport belt 8 by means of the arms 45 and 46 would be possible. The transverse pin 48 forms the rear support for the run 17 in the area of the side rims 49 and 50 and is in a slight contact with the run 17.

A lengthening 51 of the transverse pin 48 is disposed in a bearing 52 so that the bow 47 can swivel for the tensioning of the transport belt 8. In this case, according to FIG. 8, the tension force P can be applied by means of a leaf spring 53 which is fastened to a stationary holding device which is not shown.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A spinning machine comprising:

a plurality of spinning stations;

depositing sites for cans with silver;

transport devices which transport the silver from the cans to the spinning stations, the transport devices containing a plurality of transport belts which run from the area of the cans to the spinning stations;

deflecting rollers which deflect the transport belts;

guiding devices assigned to each transport belt, where each guiding device is arranged to provide guidance exclusively in an area directly in front of a deflecting roller and remote from the other deflecting rollers viewed in a running direction of the transport belt, the guiding devices each having two opposite lateral guiding elements to guide the edges of the transport belt and a supporting element to support a flat side of the transport belt arranged between the lateral guiding elements;

wherein the lateral guiding elements are separated by a distance from one another which corresponds to the width of the transport belt plus a small safety distance;

wherein the supporting element is arranged between two of the deflecting rollers in the running direction, and is situated approximately in the plane of a tangent connecting the two deflecting rollers.

2. A spinning machine according to claim 1 wherein the supporting element to constructed as a sliding surface on which the transport belt is slidably supported.

3. A spinning machine according to claim 2, wherein the supporting element extends in the longitudinal direction of the machine and is coupled to the lateral guiding elements.

4. A spinning machine according to claim 2, wherein the sliding surface is a transverse pin which is assigned to a single transport belt and is coupled to the lateral guiding elements.

* * * * *

UNITED STATES PATENT AND TRADEMARK OFFICE

CERTIFICATE OF CORRECTION

PATENT NO. : 5,291,728

DATED : March 8, 1994

INVENTOR(S) : Fritz STAHLECKER and Werner ZOTT

It is certified that error appears in the above-indentified patent and that said Letters Patent is hereby corrected as shown below:

On title page, item [22] Appl. No.:

Change the filing date from "April 20, 1993" to --April 20, 1992--.

Signed and Sealed this

Sixteenth Day of August, 1994

*Attest:*

*Attesting Officer*

Bruce Lehman

BRUCE LEHMAN

*Commissioner of Patents and Trademarks*